US005232341A

United States Patent [19]

Shier et al.

[11] Patent Number: 5,232,341

[45] Date of Patent: Aug. 3, 1993

[54] PUMP IMPELLER ASSEMBLY

[75] Inventors: Richard K. Shier, Livonia, Mich.; Robert J. White, Waterloo, Iowa; Brent R. Behrman, Norwalk; Craig A. Diem, Huron, both of Ohio; Cynthia A. Stuvel, Auburn Hills, Mich.

[73] Assignee: General Motors Corporation, Detroit, Mich.

[21] Appl. No.: 863,986

[22] Filed: Apr. 6, 1992

Related U.S. Application Data

[63] Continuation-in-part of Ser. No. 773,336, Oct. 8, 1991.

[51] Int. Cl.[5] ..... F04D 29/62

[52] U.S. Cl. ..... 415/201; 384/537; 417/360; 417/423.14

[58] Field of Search ..... 415/201, 213.1; 417/360, 363, 423.12, 423.14; 403/348, 349; 285/361, 159; 29/890.141; 384/537, 584

[56] References Cited

U.S. PATENT DOCUMENTS

| | | | |
|---|---|---|---|
| 1,779,869 | 10/1930 | Andreasen . | |
| 2,496,928 | 2/1950 | Bing et al. | 403/348 |
| 2,561,279 | 7/1951 | Holt | 403/349 |
| 2,683,006 | 7/1954 | Nichols . | |
| 2,989,925 | 6/1961 | Brehm et al. | 103/103 |
| 4,306,761 | 12/1981 | Ress, Jr. | 339/252 R |
| 4,661,044 | 4/1987 | Freeland | 415/201 |
| 4,779,516 | 10/1988 | Parker et al. | 403/349 |
| 4,827,881 | 5/1989 | Baker et al. | 123/196 R |
| 4,882,660 | 11/1989 | Liverance et al. | 362/226 |
| 5,044,883 | 9/1991 | Neueder | 415/201 |
| 5,080,501 | 1/1992 | Siebert et al. | 384/537 |
| 5,118,254 | 4/1992 | Ellingson et al. | 417/360 |
| 5,133,617 | 7/1992 | Sokn et al. | 403/348 |

*Primary Examiner*—Edward K. Look
*Assistant Examiner*—Michael S. Lee
*Attorney, Agent, or Firm*—Gordon F. Belcher

[57] ABSTRACT

A pump impeller assembly comprises a pump journal, an impeller fixed to one end of the pump journal, and a pulley fixed to the other end of the pump journal. The pump impeller assembly further comprises a pump bearing including an outer race surrounding the pump journal with the pump journal being adapted to rotate with respect to the outer race. The pump impeller assembly includes a support plate fixed to the outer race and lying in a radial plane with respect to the pump journal. The support plate has a plurality of locking tabs adjoining its peripheral edge. The locking tabs are circumferentially spaced apart from one another with respect to the pump journal. The locking tabs are adapted to interlock with locking lugs formed on the inner surface of a pump housing wherein the locking lugs are adjacent to a pulley opening in the pump housing through which the pulley extends and are circumferentially spaced apart from one another with respect to the pulley opening. The locking tabs are adapted so that the interlocking enables secure attachment of the support plate to the pump housing.

7 Claims, 2 Drawing Sheets

PUMP IMPELLER ASSEMBLY

This is a continuation-in-part of copending application Ser. No. 07/773336, filed Oct. 8, 1991 and assigned to the same assignee.

TECHNICAL FIELD

This invention relates to a pump impeller assembly for mounting in a pump housing of an engine, and more particularly to a support plate which is attached to the pump bearing and has locking tabs which interlock with locking lugs formed in the pump housing to secure the pump impeller assembly to the pump housing.

BACKGROUND

A pump journal can be surrounded by a pump bearing which has a support plate fixed to its outer surface and lying in a radial plane of the pump journal. Separate fasteners, such as bolts, are sometimes used to secure the support plate to a pump housing. In some constructions, the peripheral portion of the support plate is sandwiched between mating portions of the pump housing.

SUMMARY OF THE INVENTION

The present invention provides a pump impeller assembly comprising a pump journal, an impeller fixed to one end of the pump journal and a pulley fixed to the other end of the pump journal. The pump impeller assembly further comprises a pump bearing including an outer race surrounding the pump journal with the pump journal being adapted to rotate with respect to the outer race.

A support plate is fixed to the outer race and lies in a radial plane with respect to the pump journal. The support plate preferably has several locking tabs circumferentially located on its peripheral edge with the locking tabs having equal radial spacing from the center of the support plate. The support plate may have as few as a pair of locking tabs adjoining its peripheral edge. The locking tabs are circumferentially spaced apart from one another with respect to the pump journal. The locking tabs are adapted to interlock with locking lugs formed on the inner surface of a pump housing wherein the locking lugs are adjacent to a pulley opening in the pump housing through which the pulley extends and are circumferentially spaced apart from one another with respect to the pulley opening. The locking tabs are adapted so that the interlocking enables secure attachment of the support plate to the pump housing.

The interlocking between the locking tabs and locking lugs facilitates attachment of the support plate to the pump housing and removal of the pump impeller assembly therefrom since handling of separate fasteners is not required. Also, the means for attaching the support plate to the pump housing is particularly well-suited to assembly and disassembly of the pump impeller assembly and pump housing when the pump housing is attached to the engine and the pulley is disposed between the pump housing and engine block. Locating the pulley close to the engine block can be desirable if, for example, the pulley is driven by a belt which is driven by the camshaft which controls the cylinder intake valves. In such an arrangement, the coupling between the belt and camshaft can be close to the rear of the cylinder head. Assembly and disassembly of the support plate and pump housing in such an arrangement is facilitated by the present invention since the pulley can enter the pump housing first and exit the pump housing last, respectively. The present invention also allows removal of the pump impeller assembly from the pump housing without removing the pump housing from the engine.

BRIEF DRAWING DESCRIPTION

In the drawings.

Corresponding reference characters indicate corresponding parts throughout the several view of the drawings.

DETAILED DESCRIPTION

Figures 1, 4:
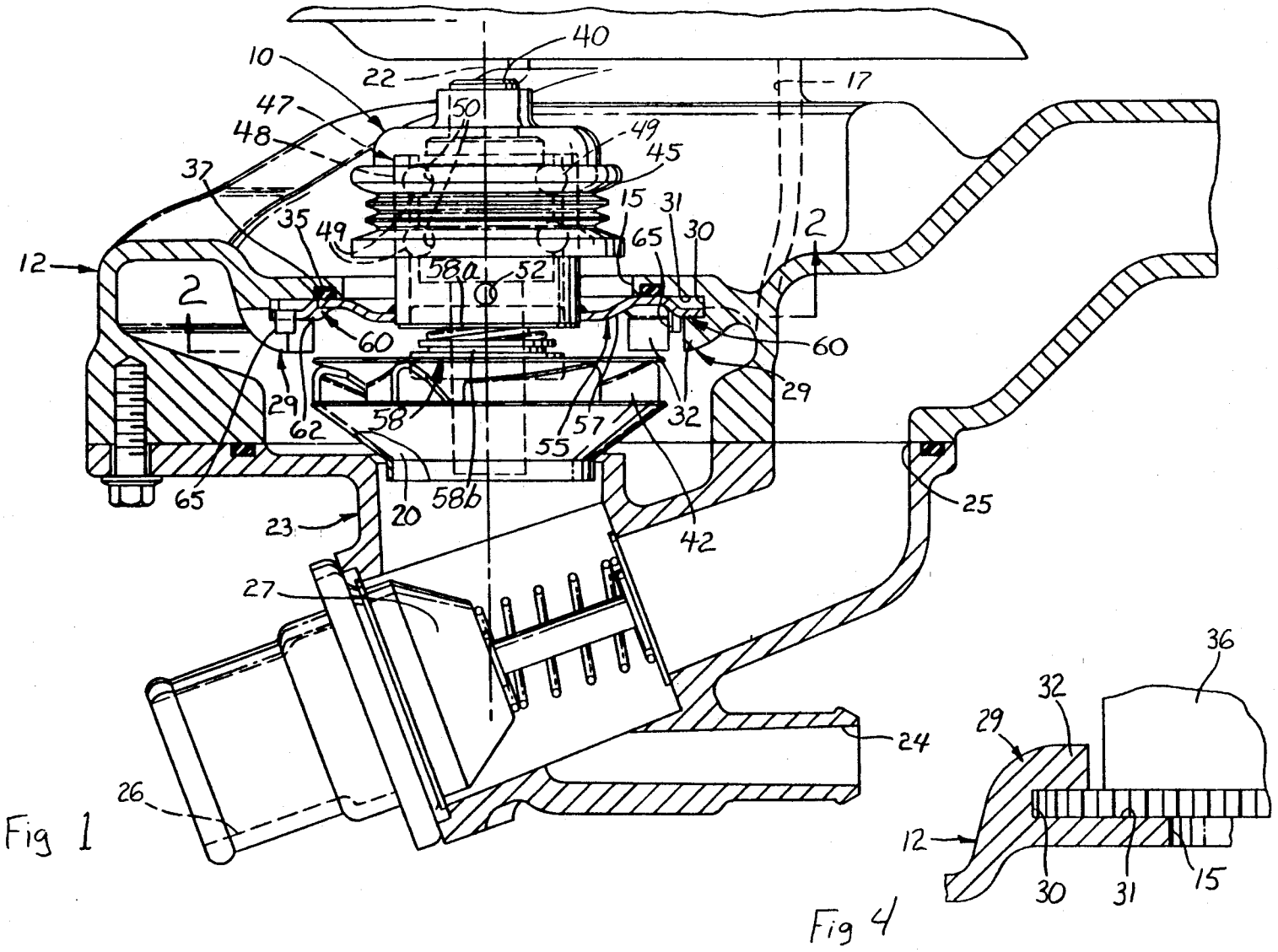
FIG. 1 is a sectional plan view of the pump impeller assembly of the present invention mounted in a pump housing.
FIG. 4 is an enlarged view of one of the locking lugs shown in FIG. 1 showing how the feed-out tool machines the undercut.

Referring to the drawings, and in particular, FIG. 1, numeral 10 generally refers to a pump impeller assembly for mounting in a pump housing 12. The pump impeller assembly 10 is particularly suited for use with a water a(or coolant) pump of an engine and will be described in connection therewith. The pump impeller assembly 10, however, can be used in a variety of other fluid pumps.

The pump housing 12 is formed of cast aluminum or iron and has a pulley opening 15. The pump housing 12 has a housing inlet 20 and a housing axis 22 which extends through the center of the housing inlet and the center of the pulley opening 15.

The pump housing 12 further includes two housing outlets 17. The two housing outlets 17 branch from a volute which is formed in the inner surface of the pump housing 12. One of the housing outlets 17 has a smaller cross section than the other housing outlet.

The pump housing 12 is mounted on the rear of the engine so that the side of the pump housing in which the pulley opening 15 is formed faces the engine. The housing outlet 17 which has a smaller outlet is bolted directly to the engine block and communicates with the left cylinder bank of the engine. The other housing outlet 17 has a larger outlet which communicates with the right cylinder bank of the engine via a heat exchanger. The housing outlets 17 are sized to enable generally equivalent coolant flows to the left and right cylinder banks.

A cover assembly 23 is bolted to the side of the pump housing 12 in which the housing inlet 20 is formed. The cover assembly 23 has a heater return inlet 24 which is supplied with coolant from the passenger compartment heater. The cover assembly 23 also has a bypass return inlet 25 which is contained in a plane which also contains the housing inlet 20. The bypass return inlet 25 registers with a passage formed in the pump housing 12 which in turn registers with a passage formed the cylinder head of in the engine block. The bypass return inlet 25 is supplied with coolant which exits the engine but does not go to the radiator or passenger compartment heater (i.e., bypasses the radiator and passenger compartment heater). The cover assembly 23 further includes a radiator inlet 26 which is supplied with coolant from the radiator. A thermostat 27 is inserted into a socket which registers with the radiator inlet 26 to control the flow of coolant from the radiator into the cover assembly 23. The thermostat 27 is designed to obstruct flow of coolant from the radiator into the cover assembly 23 when the temperature of the engine is low. The radiator inlet 26 and heater return inlet 24 are connected to their respective coolant sources by hoses.

Locking lugs 29 are integrally cast into the inner surface of the pump housing 12 adjacent to the pulley opening 15. The locking lugs 29 are circumferentially and, with the exception of one pair of locking lugs, approximately equally spaced around the pulley opening 15, and are adjacent thereto. It is also possible for all of the locking lugs 29 to be approximately equally spaced around the pulley opening 15. The inner surface of the pump housing 12 in which the locking lugs 29 are cast has an annular machined portion 31 which extends away from the pulley opening 15. The machined portion 31 extends into the locking lugs 29 thereby forming an undercut 30 in each locking lug.

Figure 3:
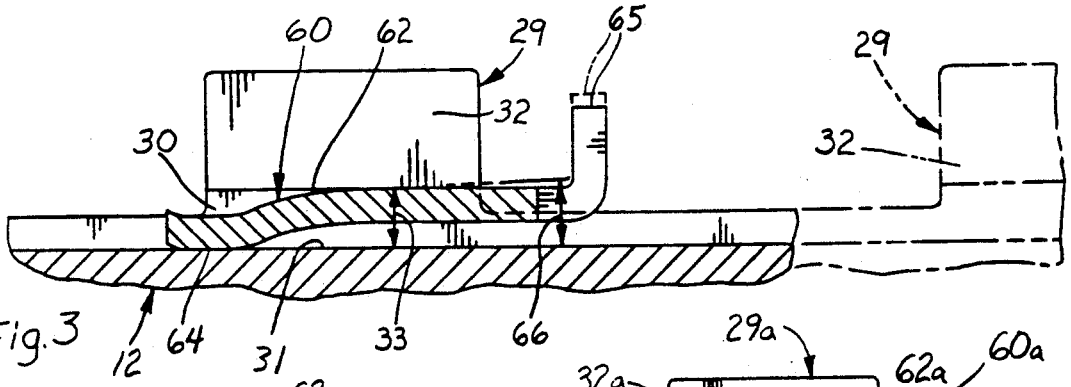
FIG. 3 is an enlarged cross-sectional view in the plane indicated by line 3—3 of FIG. 2 showing the engagement between a locking tab and locking lug.

The machined portion 31 can be formed by a feed-out tool 36 comprising a member which extends into the pump housing 12 along the housing axis 22 and has radially extending cutting surfaces. The feed-out tool 36 rotates about the housing axis 22 so that the radially extending cutting surfaces cut into the locking lugs 29 to form the undercuts 30 which lie in a radial plane with respect to the pump journal 40, as shown in FIG. 4. The portions of the locking lugs 29 which overhang the undercuts 30 constitute lug overhangs 32. The inner surface of each of the lug overhangs 32 is also machined and is parallel to the plane of the pulley opening 15. The machined portion 31 is recessed into the wall of the pump housing 12 resulting in the periphery of the machined portion being stepped. The axial spacing between the lug overhang 32 and inner surface of the pump housing 12 constitutes the undercut spacing 33 as shown in FIG. 3. The undercut spacing 33 is constant in the circumferential direction around the pulley opening 15.

The circumferential gaps between the adjacent locking lugs 29 are each equal except for one of the circumferential gaps which is smaller than the others. The smaller circumferential gap constitutes the alignment tab gap 34*a* while the remaining circumferential gaps constitute the locking tab gaps 34*b*. A bump-shaped alignment projection is formed on the pump housing 12 in the plane of the housing inlet 20 and adjacent to the alignment tab gap 34*a*.

A groove 35 is formed in the inner surface of the pump housing 12 so that the groove 35 encircles the pulley opening 15. A housing seal 37 is disposed in the entire length of the groove to encircle the pulley opening 15.

The pump impeller assembly 10 includes a pump journal 40 and an impeller 42 fixed to one end of the pump journal. A pulley 45 coaxially surrounds the pump journal 40 and is disposed between the impeller 42 and the other end of the pump journal 40. The pulley 45 is fixed to the pump journal 40 so that rotation of the pulley 45 about the axis of the pump journal 40 causes concomitant rotation of the pump journal.

A pump bearing 47 coaxially surrounds the portion of the pump journal 40 as shown in FIG. 1 and can be adjacent to the other end of the pump journal. The pulley 45 coaxially surrounds the part of the pump bearing 47 nearest to the other end of the pump journal 40. The pump bearing 47 has an outer race 48 which radially supports the pump journal 40 on balls 49. The balls 49 rest in circumferential journal grooves 50 which are formed in the pump journal 40 and outer race 48. The pump journal 40 is thereby able to rotate with respect to the outer race 48. A pair of annular grease seals encircle the pump journal 40 on opposite sides of the balls 49 to obstruct loss of the grease which lubricates the balls 49 and obstruct coolant from mixing with the grease. The part of the outer race 48 closest to the impeller 42 has a pair of diametrically opposed drain holes 52. The drain holes 52 are typically standard features on pump bearings 47 of this type. When the pump impeller assembly is installed, one of the drain holes 52 should point downward.

The pump impeller assembly 10 includes a low carbon steel support plate 55 preferably comprising SAE AISI 1008-1010 or 1008-1013 AKDQ sheet steel which is fixed to the outer race 48 by laser or beam welding. The portion of the support plate 55 which is connected to the outer race 48 is preferably formed into a cylindrical sleeve which is coaxial with the axis of the outer race 48. The surface of this cylindrical sleeve which adjoins the outer race 48 is conterminous with the surface of the support plate 55 which faces the pulley 45 (i.e., the surfaces are bounded by the same edge), with the inner edge of the support plate facing the impeller 42. The support plate 55 includes a plate base 57 which lies in a radial plane with respect to the pump housing 40. The pump impeller assembly 10 includes an annular bearing seal 58 preferably comprising any of the commercially available annular mechanical face seals for liquids. Such a bearing seal 58 comprises a first seal portion 58*a* which encircles the pump journal 40 and is press fitted into the end of the outer race 48 which faces the impeller 42. The bearing seal 58 further comprises a second seal portion 58*b* which is press fitted to the pump journal 40 between the first seal portion 58*a* and the impeller 42. An annular phenolic membrane is disposed around the pump journal 40 between the first and second seal portions 58*a*, 58*b* wherein the phenolic membrane sealingly contacts the first and second seal portions. The support plate 55 includes a plurality of integral locking tabs 60 extending from the peripheral edge of the plate base 57. The circumferential dimension of each locking tab 60 is smaller than the circumferential dimension of each locking tab gap 34*b* and is larger than the alignment tab gap 34*a*.

Each locking tab 60 comprises a radial portion 61 which extends from the periphery of the plate base 57 in the radial direction, a resilient locking ramp 62 and a tab stop 65. Each locking ramp 62 is constituted by a portion of said radial portion 61 and a circumferential extension therefrom. The peripheral edge of each locking ramp 62 has a centering portion 63 which projects outward in a radial direction so that a circle defined by the peripheral edges of the centering portions has a slightly smaller radius than the radius of the machined portion 31. Stamped into each locking ramp 62 is a radial ridge 64 which extends in the axial direction toward the pulley 45, as shown in FIG. 3. It may be preferable to form the radial ridge 64 from methods other than stamping. The radial ridge 64 is flush with the plate base 57. For some uses, it is preferable to not form the radial ridge 64 in the locking ramp 62 in order to simplify manufacturing.

Each locking ramp 62 is also inclined away from the plane of the plate base 57 in a direction toward the impeller 42 so that each locking ramp 62 forms a 4 degree angle with the plane of the plate base before assembly to the locking lugs 29. Other angle magnitudes, e.g., 3 degrees, between the locking ramp 62 and plane of the plate base 57 are possible. The inclination results in the axial dimension, between the face of the locking ramp 62 closest to the impeller 42 and the face of the locking ramp 62 which is closes to the pulley 45, being greater than the metal thickness of the locking ramp 62. This axial dimension constitutes the ramp spacing 66 as shown in FIG. 3. The inclination is sufficient so that the ramp spacing 66 is larger than the undercut spacing 33. Each locking tab 60 includes a tab stop 65 which extends away from the locking ramp 62 in the axial direction toward the impeller 42.

Figure 5:
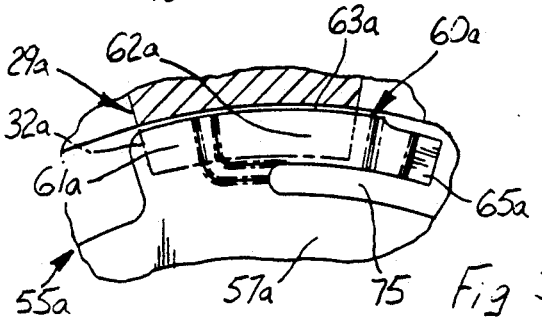
FIG. 5 is a view of an alternative embodiment of a locking tab taken in the same direction as FIG. 2.
Figure 6:
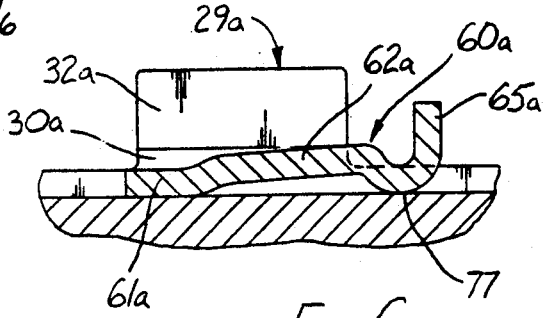
FIG. 6 is a view of the locking tab of FIG. 5 taken in the same direction as FIG. 3.

FIGS. 5 and 6 are view of an alternative embodiment of a locking tab 60*a*. Parts similar to those shown in FIGS. 2 and 3 have the same reference numeral with the addition of the suffix a. In this embodiment, a ramp slot 75 is formed between a substantial portion of the locking ramp 62*a* adjoining the tab stop 65*a* and the peripheral edge of the plate base 57*a*. A tab foot 77 is formed in the locking tab 60*a* between the locking ramp 62*a* and tab stop 65*a*, as shown in FIG. 6. The axial dimension between the base of the tab foot 77 and plane of the plate base 57*a* is less than the axial dimension between the portion of the locking ramp 62*a* which adjoins the tab foot and the plane of the plate base.

The support plate 55 includes a notched alignment tab 67 which extends away from the periphery of the plate base 57 in the radial direction. The circumferential dimension of the alignment tab 67 is smaller than the circumferential dimension of the alignment tab gap 34*a*. The alignment tab 67 has an alignment ramp 70 which is inclined in a similar manner as the locking ramp 62. The axial spacing between the side of the alignment ramp 70 closest to the impeller 42 and the side of the alignment ramp closes to the pulley 45 constitutes a tab spacing with the tab spacing being equal to the ramp spacing 66. The alignment tab 67 also includes a notched portion 72 formed on the alignment ramp 70. The notched portion may alternatively lie in the plane of the plate base 67.

Assembly

The pump impeller assembly 10 is assembled to the pump housing 12 by first bolting the pump housing 12 to the engine block with the side of the pump housing in which the pulley opening 15 is formed facing the engine. The housing seal 37 is then inserted into the groove 35 in the pump housing 12. The housing seal 37 is temporarily held in the groove 35 by grease. The pulley 45 is next inserted into the housing inlet 20 with the axis of the pump journal 40 generally coinciding with the housing axis 22. The pulley 45 is inserted through the interior of the pump housing 12 and through the pulley opening 15 so that the pulley 45 is outside of the pump housing 12, and the support plate 55 and impeller 42 are inside the pump housing 12. The pulley 45 is thereby located between the pump housing 12 and the engine enabling the pulley to be adjacent to the end of the intake valve camshaft which is rotatably connected to the pulley by a belt. The intake valve camshaft is thereby able to drive the pulley 45.

The pump impeller assembly 10 is positioned in the pump housing 12 so that the support plate 55 faces the part of the machined portion 31 parallel to the plane of the pulley opening 15. The locking tabs 60 are next inserted into the locking tab gaps 34*b* and the alignment tab 67 is inserted into the alignment tab gap 34*a* enabling insertion of the plate base 57 into the recessed machined portion 31. The centering portions 63 center the plate base 57 in the recessed machined portion 31. The notched portion 72 facilitates identification of the alignment tab 67 which must be aligned with the alignment tab gap 34*a* to enable the locking tabs 60 to align with the locking tab gaps 34*b*. The alignment projection facilitates identification of the alignment tab gap 34*a*.

With the plate base 57 inserted into the recessed machined portion 31, the castellated end of a cylindrical tool is inserted into the housing inlet 20 so that the tool coaxially surrounds the impeller 42. The ends of the projections of the castellated end abut the inner surface of the pump housing 12 in which the pulley opening 15 is formed. The axial lengths of the projections from the castellated end abut the fillets between the locking tabs 60 and plate base 57 adjacent to the tab stops 65, and the corresponding fillet between the alignment tab 67 and plate base. It is possible to support the pump impeller assembly 10 in the cylindrical tool, and insert the pump impeller assembly into the pump housing 12 and position it therein by manipulating the cylindrical tool.

Figure 2:
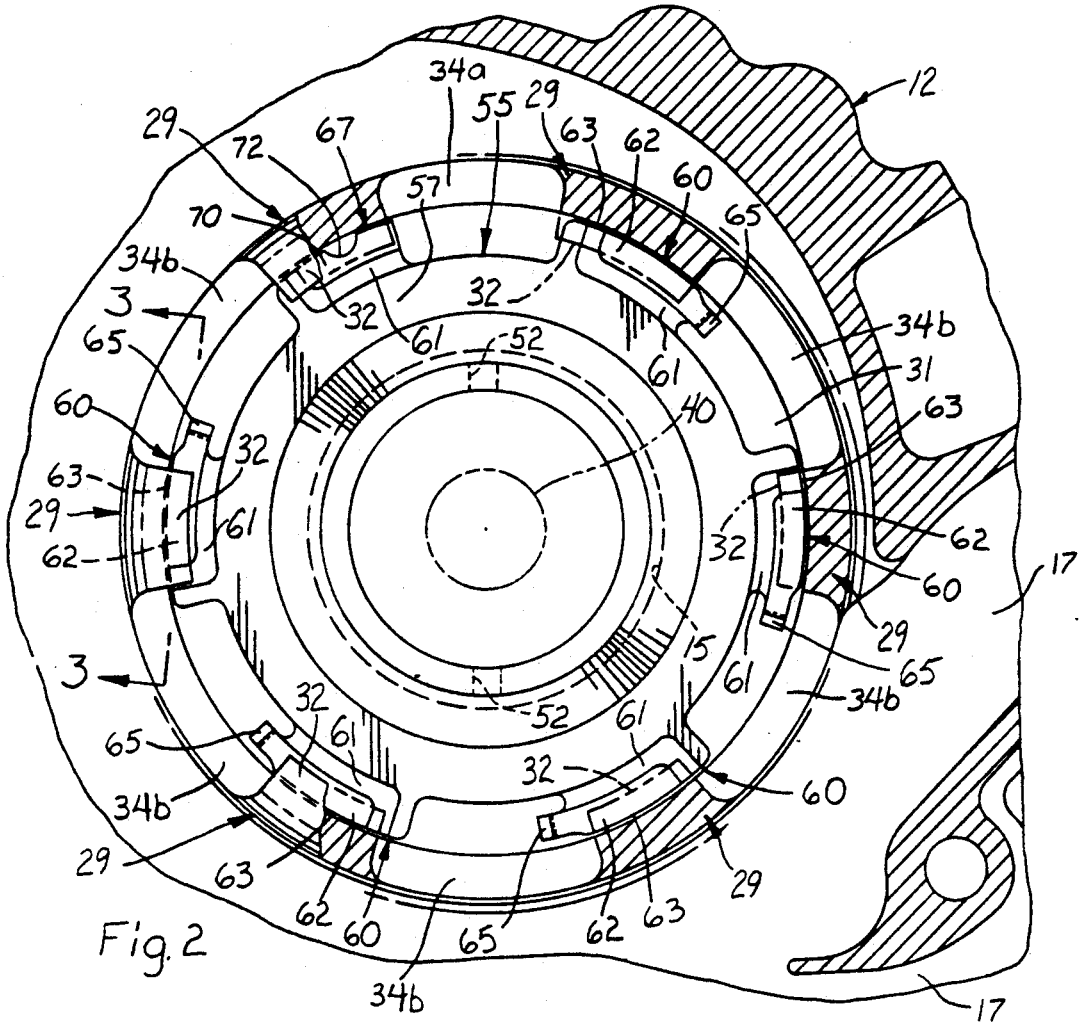
FIG. 2 is a front sectional view of the pump impeller assembly and pump housing generally in the plane indicated by line 2—2 of FIG. 1 showing the engagement between the locking tabs and locking lugs.

The cylindrical tool is then rotated about the axis of the pump journal 40 in a counterclockwise direction in the view shown in FIG. 2 so that the projections from the castellated end engage the fillets and urge the opposite ends of the locking ramps 62 into the undercuts 30. Since the end of each locking ramp 62, which initially enters an undercut 30, lies in the plane of the plate base 57, each locking ramp 62 easily enters into the undercut 30.

Continued rotation of the cylindrical tool causes the locking ramps 62 to enter further into the undercuts 30. When the portions of the locking ramps 62 having a ramp spacing 66 which equals the undercut spacing 33 enters into the undercuts 30, the radial ridges 64 engage the inner surface of the pump housing 12 (i.e., the machined portion 31) and the opposite sides of the locking ramps engage the lug overhangs 32. The radial ridges 64 limit contact between the front edge of the locking tabs 60 and the machined portion 31.

Continued insertion of the locking ramp 62 into the undercuts 30 causes deflection of the locking ramps 62. This produces an axial force between the locking ramps 62 and lug overhangs 32 as the locking ramps 62 become wedged against the lug overhangs. The rotation of the cylindrical tool which causes the locking ramps 62 to become wedged against the lug overhangs 32 also causes the alignment ramp 70 to become wedged against one of the lug overhangs in a similar manner.

The rotation of the cylindrical tool is sufficiently limited so that the tab stops 65 do not engage the lug overhangs 32, as shown in FIGS. 2 and 3. If rotation of the cylindrical tool is not sufficiently limited, engagement between the tab stops 65 and lug overhangs 32 limits insertion of the locking ramps 62 into the undercuts 30. The circumferential portion of the alignment tab 67 which interlocks with the locking lug 29 is limited so that the rear edge of the alignment tab doesn't enter the undercut 30.

The axial forces which develop between the locking ramps 62 and lug overhangs 32, and between the alignment ramp 70 and one of the lug overhangs cause the plate base 57 to be forced against the machined portion 31 of the inner surface of the pump housing 12. The extended centering portions 63 limit contact between the tab stops 65 and axial parts of the machined portion 31. The torque which is applied to the cylindrical tool is controlled so that the housing seal 37 is sufficiently compressed between the plate base 57 and inner surface of the pump housing 12 to resist leakage from the interior of the pump housing through the pulley opening 15.

The axial forces which develop between the locking ramps 62 and lug overhangs 32, and between the alignment ramp 70 and one of the lug overhangs 32 creates frictional forces between the adjoining ramps and lug overhangs which resist rotation of the support plate 55 with respect to the housing axis 22. This frictional resistance to rotation is increased by the 4 degree (other angle magnitudes are possible, e.g., 3 degrees) initial inclination of the locking ramps 62 and alignment ramp 70. The inclination between the locking ramps 62 and alignment ramp 70 decreases as the ramps enter into the undercuts 30. Since the inclination of the locking ramps 62 and alignment ramp 70 remains less than 7 degrees (the self-locking angle of repose between the dry steel ramps and aluminum lug overhangs 32 is 7 to 9 degrees), the locking tabs 60 and alignment tab 67 are tightly held against the lug overhangs 32.

The torque which is applied to the cylindrical tool is further controlled so that the frictional forces are sufficient to resist rotation of the support plate 55 around the housing axis 22 resulting in the locking tabs 60 and alignment tab 67 being securely interlocked with the locking lugs 29. The locking tabs 60 and alignment tab 67, and lug overhangs 32 can be subjected to differential thermal expansion, vibration, and housing deformation (or creep) and remain tightly interlocked due to the resiliency of the tabs. The resiliency of the locking tabs 60 and alignment tab 67 and/or their ability to somewhat plastically deform also resulting equalization of the forces between the individual tabs and lug overhangs 32 which can differ due to dimensional differences among the parts.

When the locking tab 60*a* shown i FIGS. 5 and 6 enters into an undercut 30*a*, the locking ramp 62*a* initially deflects int eh manner of a cantilever beam. Continued insertion of the locking ramp 62*a* into the undercut 30*a* eventually causes the tab foot 77 to engage the machined portion 31*a* of the inner surface of the pump housing 12*a* so that the locking ramp 62*a* is supported in the manner of a simple beam. This provides increased support to the locking ramp 62*a* and reduces the stress produced in the boundary between the locking ramp 60*a* and plate base 57*a*. In addition, the locking ramp 60*a* returns more closely to its undeflected position, with respect to the plate base 57*a*, upon its disengagement from the locking lug 29*a*. This limits any decrease in the force between the plate base 57*a*and the machined portion 31 of the inner surface of the pump housing 12*a* which can result from repeated engagement and disengagement between the locking tab 60*a*and locking lug 29*a*. Also, tight mating between the plate base 57*a*, and the machined portion 31 of the inner surface of the pump housing 12*a* throughout the entire circumference of the plate base is facilitated. This results in compression of the entire length of the seal 37 thereby enabling the entire seal to obstruct coolant flow.

It is possible for the support plate 55 to have as few as two locking tabs 60 which are diametrically opposed to one another with respect to the pump journal 40. Such a support plate 55 would require two locking lugs 29 which are diametrically opposed to one another with respect to the pulley opening 15.

The cylindrical tool is removed from the housing by rotating the projections of the castellated end about the housing axis 22 so that they separate from the locking tabs 60. The cylindrical tool is then pulled along the housing axis 22 so that it exits the pump housing 12 through the housing inlet 20.

The alignment tab 67 is angularly aligned with respect to the drain hole 52, and the alignment tab gap 34*a*is aligned with respect to the bottom of the pump housing 12 so that, when the locking tabs 60 and alignment tab 67 are interlocked with the locking lugs 29, one of the drain holes points downward. Any other alignment of the drain holes 52 with respect to the bottom of the pump housing 12 is prevented by the locking tabs 60 being unable to enter into the narrower alignment tab gap 34*a*.

With the cylindrical tool removed from the pump housing 12, the cover assembly 23 is bolted to the pump housing 12 to cover the housing inlet 20. A seal gasket is disposed between the cover assembly 23 and pump housing 12. The above assembly procedure can done before the pump housing 12 is bolted to the engine block, and this can be preferable in some mass production operations.

The pump impeller assembly 10 is removed from the pump housing 12 by unbolting the cover assembly 23 from the pump housing and inserting the castellated end of the cylindrical tool into the pump housing 12 through the housing inlet 20. The cylindrical tool is oriented so that it coaxially surrounds the impeller 42. The ends of the projections from the castellated end are inserted against the fillets between the locking tabs 60 and plate base 57 opposite from tab stops 65, and the corresponding fillet between the alignment tab 67 and plate base.

The cylindrical tool is then rotated in the opposite direction from that which caused the locking tabs 60, alignment tab 67 and locking lugs 29 to interlock with one another, i.e., in a clockwise direction in the view shown in FIG. 2. This causes the projections from the castellated end to engage the fillets causing the locking tabs 60 and alignment tab 67 to disengage from the locking lugs 29.

The cylindrical tool is then removed from the pump housing 12 by pulling it out of the housing inlet 20 along the housing axis 22. The pump impeller assembly 10 is similarly removed from the pump housing 12 through the housing inlet 20 by pulling it along the housing axis 22. The housing seal 37 can be removed from the groove 35, if necessary.

It is possible to use the support plate 55 to attach other rotating journals which are supported in bearings, to a member having locking lugs similar to locking lugs 29. Such uses could include an alternator, an air conditioning compressor, an idler pulley and a belt tensioner.

It is also possible for the locking tabs 60 to be formed in an annular locking flange and not in the surface plate 55. Such an annular locking flange has locking tabs 60 around its periphery and centering tabs around its periphery between the locking tabs. The annular locking flange encircles the pump journal 40 and is positioned so that the centering tabs abut the ends of the lug overhangs 32 thereby centering the locking flange. The locking tabs 60 are then wedged into the undercuts 30 as described above. The support plate is clamped between the annular locking flange and the part of the machined portion 31 in the plane of the pulley opening 15 to attach the support plate to the pump housing 12. Such an annular locking flange is disassembled from the pump housing 12 in a similar manner as the support plate 55.

Operation

In operation, with the 1 impeller assembly 10 and cover assembly 23 assembled to the pump housing 12, coolant enters the cover assembly 23 through either the heater return inlet 24, bypass return inlet 25 or radiator inlet 26. Flow into the cover assembly 23 from the bypass return inlet 25 is controlled by a spring loaded poppet valve which opens when the pressure in the bypass return inlet exceeds a predetermined amount. Flow into the cover assembly 23 from the radiator inlet 26 is controlled by the thermostat which is mounted in the cover assembly. The bypass return inlet 25 enables the required coolant circulation to be maintained through the engine during cool operation when the thermostat is obstructing coolant flow from the radiator.

A belt, which is wound around a portion of the camshaft which controls the cylinder intake valves, is also wound around a portion of the pulley 45 to drive it thereby causing concomitant rotation of the pump journal 40 and impeller 42. The camshaft is coupled to the crankshaft so that rotation of the crankshaft causes concomitant rotation of the camshaft. The rotation imparted to the pulley 45, pump journal 40 and impeller 42 by the belt is in the counterclockwise direction in the view shown in FIG. 2. Such counterclockwise rotation causes resistance to disengagement of the locking tabs 60 from the locking lugs 29 since the support plate 55 must be rotated in a clockwise direction, in the view shown in FIG. 2, to cause such disengagement.

The coolant in the cover assembly 23 flows through the housing inlet 20 into the interior of the impeller 42 and is slung outward into the volute. The coolant exits the volute through the two housing outlets 17 with a portion of the coolant flowing through one of the housing outlets directly to the left cylinder bank. The remainder of the coolant flows through the other housing outlet 17 to a heat exchanger and circulates through it to cool the exhaust gas which is recirculated into the intake system of the engine. The coolant in the heat exchanger exits from it and flows directly to the right cylinder bank.

The press fit between the first seal portion 58*a* and the outer race 48 obstructs leakage of coolant between them. The press fit between the second seal portion 58*b* and pump journal 40 obstructs leakage of coolant between them. The phenolic membrane between the first and second seal portions 58*a*, 58*b* obstructs leakage of coolant between them. The bearing seal 58 thereby obstructs leakage of coolant from the region of the pump housing 12 which receives coolant from the impeller 42 into the portion of the pump bearing 47 between the bearing seal and adjacent grease seal. Any liquid which is not obstructed by the bearing seal 58 and enters into the pump bearing 47 between the bearing seal 58 and nearest grease seal is able to drain from it through the drain hole 52 which is on the underside of the pump bearing.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The embodiments of the invention in which an exclusive property or privilege is claimed are defined as follows:

1. A pump impeller assembly for use with a pump housing having an opening and a plurality of locking lugs spaced circumferentially about said opening, said assembly comprising:

a pump journal;

an impeller fixed to one end of said pump journal and adapted to be received in said housing;

a pulley fixed to the other end of said pump journal and sized to pass through said opening;

a pump bearing including an outer race surrounding said pump journal, said journal being adapted to rotate with respect to said outer race; and a support plate fixed to said outer race and extending radially with respect to said pump journal, said support plate having a plurality of locking tabs extending rom its peripheral edge, said locking tabs being adapted to interlock with said locking lugs and thereby securely attach said support plate to the pump housing.

2. A pump impeller assembly as set forth in claim 1 wherein each of said locking tabs extends in a substantially circumferential direction so that said interlock is accomplished by rotating said support plate about the axis of the housing opening and with respect to the locking lugs.

3. A pump impeller assembly as set forth in claim 1 wherein each of said locking tabs comprises a radial portion extending from the periphery of said plate and a locking ramp constituted by a portion of said radial portion and a circumferential extension therefrom, said locking ramp being inclined away from the plane of said plate, said locking tab further comprising a tab foot adjoining the end of said locking ramp opposite from said radial portion, the axial dimension between the base of said tab foot and the plane of said plate being less than the axial dimension between the portion of said locking ramp which adjoins said tab foot and the plane of said plate base, said locking tab being adapted so that when it interlocks with said locking lug, the locking ramp initially deflects in the manner of a cantilever beam toward the plane of said plate base and wherein continued defection of said locking ramp causes said tab foot to engage said housing so that said locking ramp is supported in the manner of a simple beam.

4. A pump impeller assembly as set forth in claim 3 wherein a slot is formed between a substantial portion of said locking ramp adjoining said tab stop and the peripheral edge of said plate.

5. A pump impeller assembly as set forth in claim 1 wherein said outer race has a drain hole, said support plate including an alignment tab extending from its peripheral edge, said alignment tab being adapted to interlock with one of said locking lugs, the circumferential size of said alignment tab being different from the size of said locking tabs, the circumferential spacing of said locking lugs permitting said locking tabs and alignment tab to interlock with the locking lugs only when said drain hole faces the lower surface of the pump housing.

6. A pump impeller assembly as set forth in claim 1 wherein each of said locking lugs includes a lug overhang which extends radially inward toward the axis of said housing opening, said lug overhangs being spaced apart from the inner surface of said housing whereby an undercut is formed in each of said locking lugs, and wherein each of said locking tabs is adapted for insertion into one of said undercuts to enable said locking tab to interlock with said locking lug.

7. The pump impeller assembly of claim 1 wherein said support plate sealingly engages said housing about said opening and radially inwardly of said locking lugs.

* * * * *